US008702062B2

(12) United States Patent
Papke et al.

(10) Patent No.: US 8,702,062 B2
(45) Date of Patent: Apr. 22, 2014

(54) JACK MOUNT/SYSTEM AND VEHICLE INCORPORATING SAME

(75) Inventors: Clark S. Papke, Cortland, NE (US); Gary L. Nicholson, Beatrice, NE (US)

(73) Assignee: Exmark Manufacturing Company, Incorporated, Beatrice, NE (US)

( * ) Notice: Subject to any disclaimer, the term of this patent is extended or adjusted under 35 U.S.C. 154(b) by 348 days.

(21) Appl. No.: 12/618,048

(22) Filed: Nov. 13, 2009

(65) Prior Publication Data

US 2011/0114906 A1 May 19, 2011

(51) Int. Cl.

| | |
|---|---|
| ***B66F 5/02*** | (2006.01) |
| ***B66F 7/10*** | (2006.01) |
| ***B66F 3/24*** | (2006.01) |
| ***B66F 3/00*** | (2006.01) |

(52) U.S. Cl.
USPC .... 254/133 R; 254/2 B; 254/89 H; 254/93 R; 254/134

(58) Field of Classification Search
USPC .. 254/133 R, 2 B, 89 H, 93 R, 7 B, 134, 424, 254/111
See application file for complete search history.

(56) References Cited

U.S. PATENT DOCUMENTS

| | | | | |
|---|---|---|---|---|
| 1,213,994 | A | | 1/1917 | Anderson |
| 1,268,101 | A | | 6/1918 | Drew |
| 1,955,649 | A | | 4/1934 | Nuccio |
| 2,012,554 | A | | 8/1935 | Travis |
| 2,108,888 | A | | 2/1938 | Gunter |
| 2,240,430 | A | | 4/1941 | Willard |
| 2,456,375 | A | * | 12/1948 | Cedarholm ..... 254/134 |
| 2,577,539 | A | * | 12/1951 | Page ..... 60/474 |
| 2,616,746 | A | * | 11/1952 | Chapman ..... 294/82.13 |
| 3,477,734 | A | | 11/1969 | Albertson |
| 3,733,051 | A | | 5/1973 | Bollinger |
| 3,744,757 | A | | 7/1973 | White et al. |
| 3,758,077 | A | * | 9/1973 | Fisher ..... 254/133 R |
| 3,779,517 | A | | 12/1973 | Fisher |
| 3,841,604 | A | * | 10/1974 | Haynes ..... 254/111 |
| 4,277,050 | A | | 7/1981 | Mostert |
| 4,469,348 | A | | 9/1984 | Crook |
| 4,549,721 | A | | 10/1985 | Stone |
| 4,779,406 | A | | 10/1988 | Schroeder |
| 4,829,754 | A | | 5/1989 | Shimamura et al. |
| 4,897,013 | A | | 1/1990 | Thompson et al. |
| 4,958,804 | A | | 9/1990 | Lenius et al. |

(Continued)

OTHER PUBLICATIONS

Bulldog—Round Jacks. Cequent Performance Products. Retrieved from the internet on Dec. 22, 2009 from http://www.bulldogproducts.net/product/accessory.asp?cat=7520&path=7520&titulo=Round%20Jacks. 3 pages; 2009.

(Continued)

*Primary Examiner* — Lee D Wilson
*Assistant Examiner* — Seahee Yoon
(74) *Attorney, Agent, or Firm* — Mueting, Raasch & Gebhardt, P.A.

(57) ABSTRACT

A jacking apparatus including a jack mount, the apparatus for use with a vehicle such as a riding lawn mower. The jack mount is, in one embodiment, configured to be attached to and removed from the vehicle without the use of tools. In one embodiment, the jack mount includes two jaws that effectively clamp to a frame of the mower. The clamping force is generated by the weight of the mower acting against a jacking force applied to the jack mount by an extensible jacking device.

17 Claims, 7 Drawing Sheets

(56) References Cited

U.S. PATENT DOCUMENTS

| | | | | |
|---|---|---|---|---|
| 5,000,423 | A | 3/1991 | Snickers | |
| 5,079,907 | A | 1/1992 | Sameshima et al. | |
| 5,096,171 | A | 3/1992 | Kendrick et al. | |
| 5,228,651 | A | 7/1993 | Warner | |
| 5,324,005 | A | 6/1994 | Beattie et al. | |
| 5,421,611 | A | 6/1995 | Peterson et al. | |
| 5,475,971 | A | 12/1995 | Good et al. | |
| 5,515,669 | A | 5/1996 | Schick et al. | |
| 5,678,804 | A | 10/1997 | Lintelman et al. | |
| 5,702,089 | A | 12/1997 | Hurd | |
| 5,816,035 | A | 10/1998 | Schick | |
| 5,826,857 | A | 10/1998 | Brack et al. | |
| 5,971,360 | A | 10/1999 | Sinsley | |
| 6,053,477 | A | 4/2000 | Price | |
| 6,330,997 | B2 | 12/2001 | McGlaun et al. | |
| 6,434,919 | B2 * | 8/2002 | Schick | 56/15.9 |
| 6,516,597 | B1 * | 2/2003 | Samejima et al. | 56/16.7 |
| 6,701,699 | B2 * | 3/2004 | Fontanes, II et al. | 56/16.7 |
| 6,786,031 | B2 * | 9/2004 | Kalista et al. | 56/16.7 |
| 6,851,253 | B2 | 2/2005 | Fontanes, II et al. | |
| 2003/0079454 | A1 | 5/2003 | Samejima et al. | |
| 2004/0065071 | A1 | 4/2004 | Kalista et al. | |
| 2004/0154274 | A1 | 8/2004 | Samejima et al. | |
| 2004/0159826 | A1 * | 8/2004 | Peschmann et al. | 254/420 |
| 2004/0261387 | A1 * | 12/2004 | Kalista et al. | 56/16.7 |
| 2008/0053054 | A1 | 3/2008 | Okamoto et al. | |

OTHER PUBLICATIONS

Jack Mount Kit. Exmark Mfg. Co., Inc. Part No. 4500-454 Rev. A. 3 pages; 2009.

* cited by examiner

JACK MOUNT/SYSTEM AND VEHICLE INCORPORATING SAME

TECHNICAL FIELD

The present invention is directed to jack mounts and jack systems, and to vehicles (e.g., ground maintenance vehicles) that incorporate the same.

BACKGROUND

Ground maintenance vehicles for performing a variety of tasks are known. For instance, vehicles designed for or having grass cutting decks or other attachments (e.g., for lawn/soil fertilizing, aerating, dethatching, vacuuming/blowing, and the like) are available. While embodiments of the present invention are applicable to most any ground maintenance vehicle or, for that matter, to most any type of vehicle, they will, for the sake of brevity, be described with respect to riding lawn mowers incorporating a grass cutting deck.

For lawns having numerous obstacles, tight spaces, and/or intricate borders, mowers having zero-radius-turning (ZRT) capability are known. As the name implies, "ZRT" generally indicates a vehicle having a very tight minimum turning radius. While advantageous due to their high degree of maneuverability, ZRTs are also adept at mowing large, open areas. This versatility makes ZRT mowers popular among both homeowners and professionals alike.

As with other mowers, ZRTs are subject to regular maintenance to ensure consistent operation. For instance, sharpening/changing of the cutting blades and cleaning of the cutting deck are needed periodically to ensure that optimal cutting efficiency is maintained. Accordingly, mowers that provide convenient access to the underside of the cutting deck are advantageous.

One ZRT mower configuration that provides convenient access to the deck is referred to as an "outfront" mower. As the name implies, outfront ZRTs position the cutting deck in front of the vehicle and, as such, may allow the cutting deck to be easily raised, often to a position that is 90 degrees or more from the operating position. While advantageous, positioning the cutting deck forward of the vehicle results in a longer and sometimes more complex mower configuration.

An alternative to outfront ZRTs are "mid-mount" mowers. Mid-mount ZRTs position the cutting deck underneath the mower frame between the forward wheels and the rear wheels, allowing a shorter overall vehicle length and a potentially less complex deck/vehicle interconnection. Mid-mount ZRTs may not, however, provide the convenient flip-up deck of their outfront counterparts. Accordingly, deck maintenance, e.g., blade replacement and deck cleaning, may necessitate either access: via the limited space available between the deck and the ground; or, alternatively, via jacking of the mower.

Some advanced ZRT mowers may incorporate an on-board jacking device to raise the mower to a desired height. While such mechanisms have proven to be effective and well-suited for larger framed commercial machines, they may be cost and/or space prohibitive for smaller mowers. Accordingly with the latter, a jack attachment point may be integrally formed or fixed to the mower frame. The jack attachment point may selectively connect to an external jacking device that may then apply a lifting force to the mower. Depending on the mower size and jack point configuration, integral jack points may have certain disadvantages, e.g., undesirable aesthetic appearance of the jack point, potential interference with some mower operations, dedicated jack point needed for each mower unit, etc.

SUMMARY

The present invention may overcome these and other issues with prior art vehicles and jacking systems/apparatus by providing, in one embodiment, a jacking apparatus for elevating a portion of a vehicle relative to a ground surface. The apparatus includes a jack mount removably attachable to a frame of the vehicle, wherein the jack mount includes: a first jaw having a first contact surface configured to engage a first portion of the frame; a second jaw comprising a second contact surface configured to engage a second portion of the frame, the second jaw pivotally connected to the first jaw via a pivot joint such that the second contact surface pivotally opposes the first contact surface; and a jack receiving member located on the second jaw.

In another embodiment, a jacking apparatus for elevating one end of a vehicle relative to a ground surface is provided and includes a jack mount removably attachable to a frame of the vehicle. The jack mount includes: a first jaw having a first contact surface that is configured to engage a lower portion of the frame. The jack mount further includes a second jaw pivotally attached to the first jaw via a pivot joint, the second jaw including: a first end defining a second contact surface configured to engage an upper portion of the frame; and a second end defining a jack receiving member, wherein the pivot joint is located between the second contact surface and the jack receiving member. The apparatus further includes an extensible jacking device having: a jack point configured to attach to the jack receiving member of the jack mount; and a ground contacting portion.

In yet another embodiment, a lawn mower is provided and includes: a frame comprising a footrest; and a jacking apparatus for elevating a forward end of the mower relative to a ground surface. The apparatus includes a jack mount removably attachable to the footrest of the mower. The jack mount includes: a first jaw having a first contact surface to engage a lower portion of the footrest; and a second jaw having a second contact surface for engaging a toe board of the footrest, the second jaw pivotally connected to the first jaw, wherein the second jaw further comprises a jack receiving member. The lawn mower further comprises an extensible jacking device having: a jack point configured to removably attach to the jack receiving member of the jack mount; and a ground contacting portion. Application of a vertical jacking force by the jacking device to the jack mount causes the first and second jaws to clamp to the footrest.

The above summary is not intended to describe each embodiment or every implementation of the present invention. Rather, a more complete understanding of the invention will become apparent and appreciated by reference to the following Detailed Description of Exemplary Embodiments and claims in view of the accompanying figures of the drawing.

BRIEF DESCRIPTION OF THE VIEWS OF THE DRAWING

The present invention will be further described with reference to the figures of the drawing, wherein.

Figure 1:
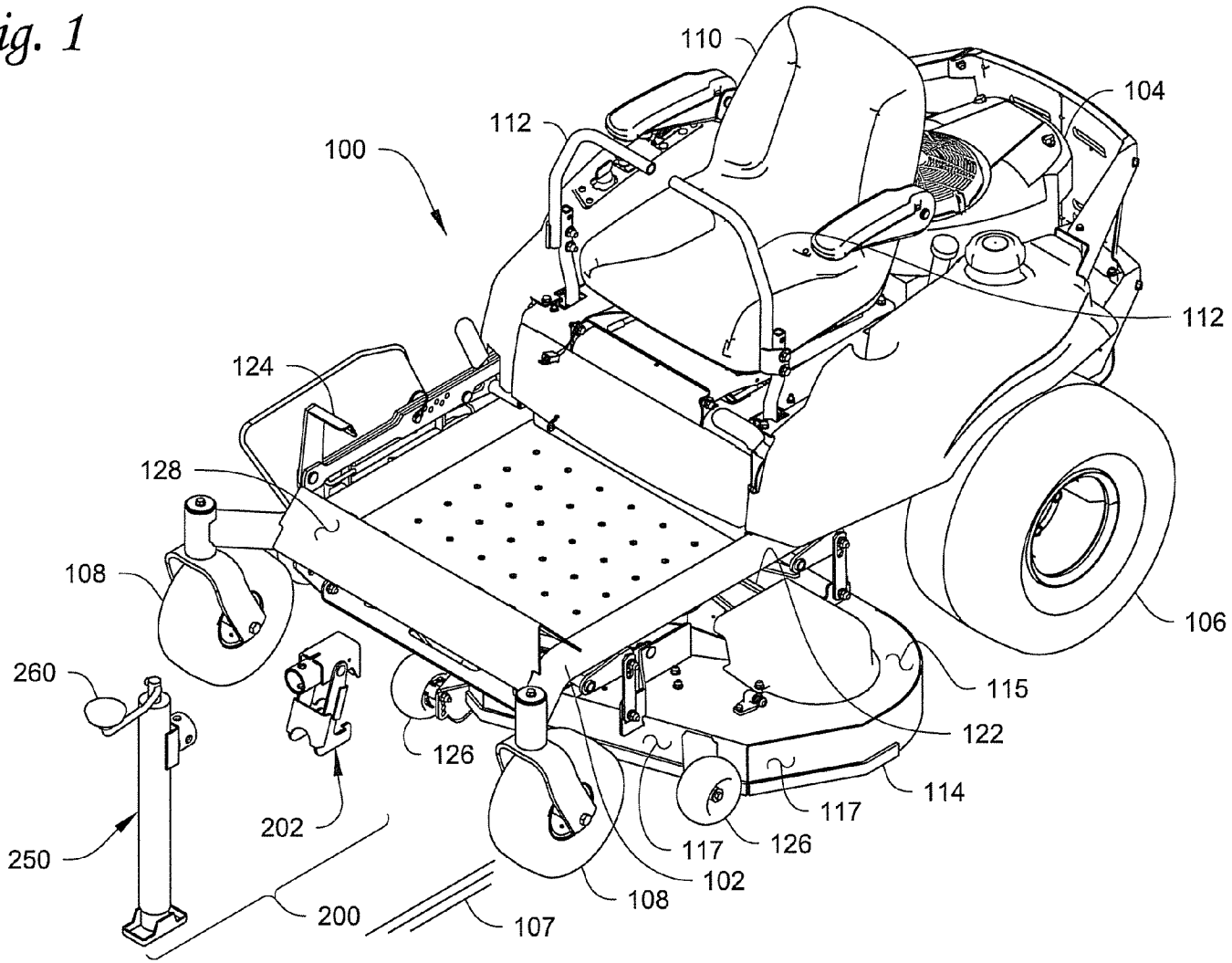
FIG. 1 is a perspective view of a vehicle, e.g., a lawn mower, having a jacking apparatus including a jack mount and a jacking device in accordance with one embodiment of the invention, wherein the jacking apparatus is shown separated from the mower and the mower is shown in an operating configuration.

The figures are rendered primarily for clarity and, as a result, are not necessarily drawn to scale.

DETAILED DESCRIPTION OF EXEMPLARY EMBODIMENTS

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

Generally speaking, embodiments of the instant invention are directed to ground maintenance vehicles and accompanying jacking apparatus, systems, and methods for use with the same. In some embodiments, the apparatus includes a jack mount that may be removed from and attached to the vehicle without the use of tools or additional fasteners. As a result, the jack mount may be easily attached when needed for maintenance activities, and removed from the frame at maintenance completion. In that manner, the jack mount is not present during normal vehicle operation. Moreover, the jack mount may connect to a jacking device used to apply a lifting force. The jack mount may include provisions that allow it to provide both fore-and-aft, as well as side-to-side, stability to the jacking device.

FIG. 1 illustrates an exemplary ground maintenance vehicle, e.g., ZRT riding mower 100, and a jacking system or apparatus 200 in accordance with one embodiment of the invention. The vehicle, as shown in FIG. 1, may be configured as a ZRT power riding lawn mower. However, while described herein with respect to a ZRT mower, those of skill in the art will realize that embodiments of the present invention are also applicable to other ground maintenance vehicles or, for that matter, to most any other type of vehicle.

FIG. 1 illustrates the exemplary vehicle, e.g., mower 100, having underlying structure (a mower frame or chassis 102) that supports a prime mover, e.g., internal combustion engine 104 (or, alternatively, electric motor). A pair of transversely opposing, ground engaging drive members, e.g., drive wheels 106 (only left wheel visible in FIG. 1) may support the mower 100 in active driving engagement upon a ground surface 107. Other ground engaging members, e.g., castoring front wheels 108, may support the front of the mower on the ground surface as shown. Each drive wheel 106 may be powered by a hydrostatic motor (not shown) which receives power from a hydraulic pump under the control of an operator. The hydraulic pump, in turn, may be powered by the engine 104. Other wheel drive systems (e.g., mechanical systems) and drive configurations (e.g., tri-wheel) are also possible without departing from the scope of the invention. Moreover, while the mower 100 is illustrated and described herein as utilizing an internal combustion engine and hydraulic drives, other power sources and drive systems (e.g., electric motors) are also contemplated.

The mower 100 may further include a seat 110 (see FIG. 1) to accommodate an operator. Various controls, e.g., ZRT drive control levers 112, may be accessed by the operator from the seat during operation. In the illustrated embodiment, the mower 100 includes what is often referred to as a twin lever control system wherein left and right levers 112 control, respectively, the speed and rotational direction of the left and right drive wheels 106. Accordingly, mower speed and direction may be controlled by selective manipulation of the two drive control levers 112.

An implement, e.g., cutting deck 114, may be attached, in this embodiment, generally between the front and rear wheels as shown in what is commonly referred to as a mid-mount configuration. The cutting deck 114 may form a housing defined by a generally horizontal upper surface 115 and generally vertical peripheral side skirts 117 extending downwardly from the upper surface. The housing (upper surface 115 and skirts 117) of the cutting deck 114 may define a chamber that houses one or more cutting blades (not shown) as is known in the art.

The upper surface 115 of the deck may include apertures through which journalled shafts or spindles (not shown) extend. A power coupler, e.g., driven pulley (also not shown), may be attached to an upper end of each spindle, while a cutting blade as is known in the art (not shown) may be attached to a lower end. The pulley may be keyed or otherwise fixed to the spindle such that rotation of the pulley results in corresponding rotation of the spindle and thus the blade.

A mechanical drive member such as an endless belt 122, may be positioned about, e.g., routed around, each driven pulley as well as around a driving pulley (not shown) powered by the engine 104. During operation, the belt 122 may selectively transmit power from the driving pulley to the driven pulleys. As a result, the driven pulleys, spindles, and cutting blades rotate at a speed sufficient for the blades to cut grass and other vegetation over which the deck passes.

The mower 100 may also include a height-of-cut adjustment mechanism 124 to allow the operator to selectively control the elevation of the cutting deck 114 relative to the ground surface 107. In the illustrated embodiment, the mechanism is actuated via a foot pedal, although alternative actuation mechanisms are contemplated. Other mower and deck features (e.g., anti-scalp wheels 126) as are known in the art may also be included but are not further described herein.

Relative terms such as "left," "right," "fore," "forward," "aft," "rearward," "top," "bottom," "upper," "lower," "horizontal," "vertical," and the like are, if used herein, from the perspective of one operating the mower 100 while the mower is in an operating configuration, e.g., while the mower 100 is positioned such that the wheels 106, 108 rest upon the generally horizontal ground surface 107 as shown in FIG. 1. These terms are used herein only to simplify the description, however, and not to limit the scope of the invention in any way.

Figure 2:
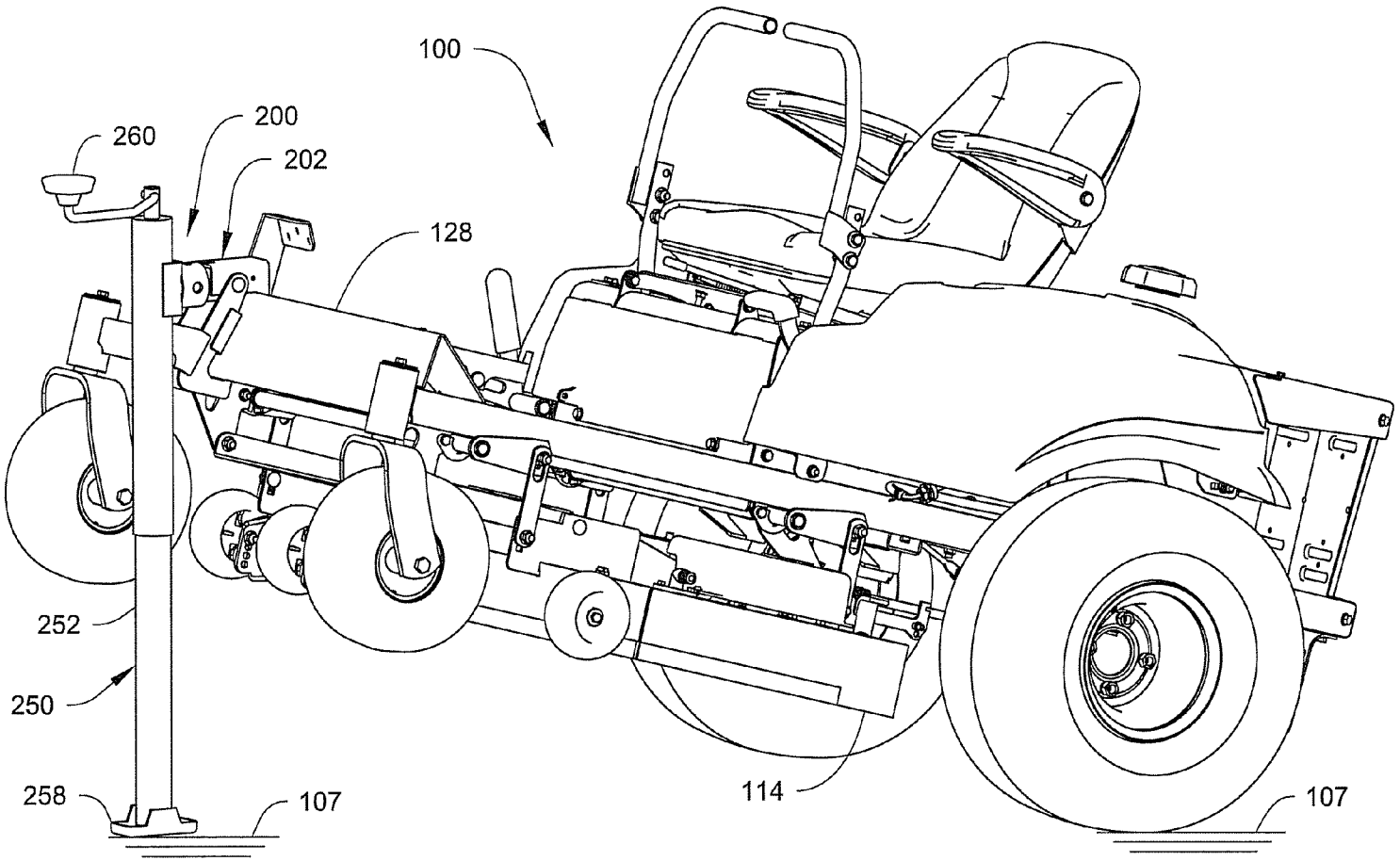
FIG. 2 is a perspective view of the mower of FIG. 1, wherein the jacking apparatus is shown attached and the mower is shown in an elevated or maintenance configuration.

FIG. 1 further illustrates a jacking apparatus 200 in accordance with one embodiment of the invention. In the illustrated embodiment, the jacking apparatus 200 includes both a jack mount 202 and an extensible jacking device 250. Both of these components may be coupled to/de-coupled from each other and to/from the mower 100 as needed. As shown in FIG. 2, when correctly coupled to each other and to the mower 100, the jacking apparatus 200 (e.g., jack mount 202 and jacking device 250) may be used to elevate at least one end or portion of the mower 100 relative to both the opposite end/portion and to the ground surface 107. When the mower is repositioned from an operating configuration as shown in FIG. 1 to an elevated maintenance configuration as shown in FIG. 2, improved access to the underside of the cutting deck may result.

Figure 3:
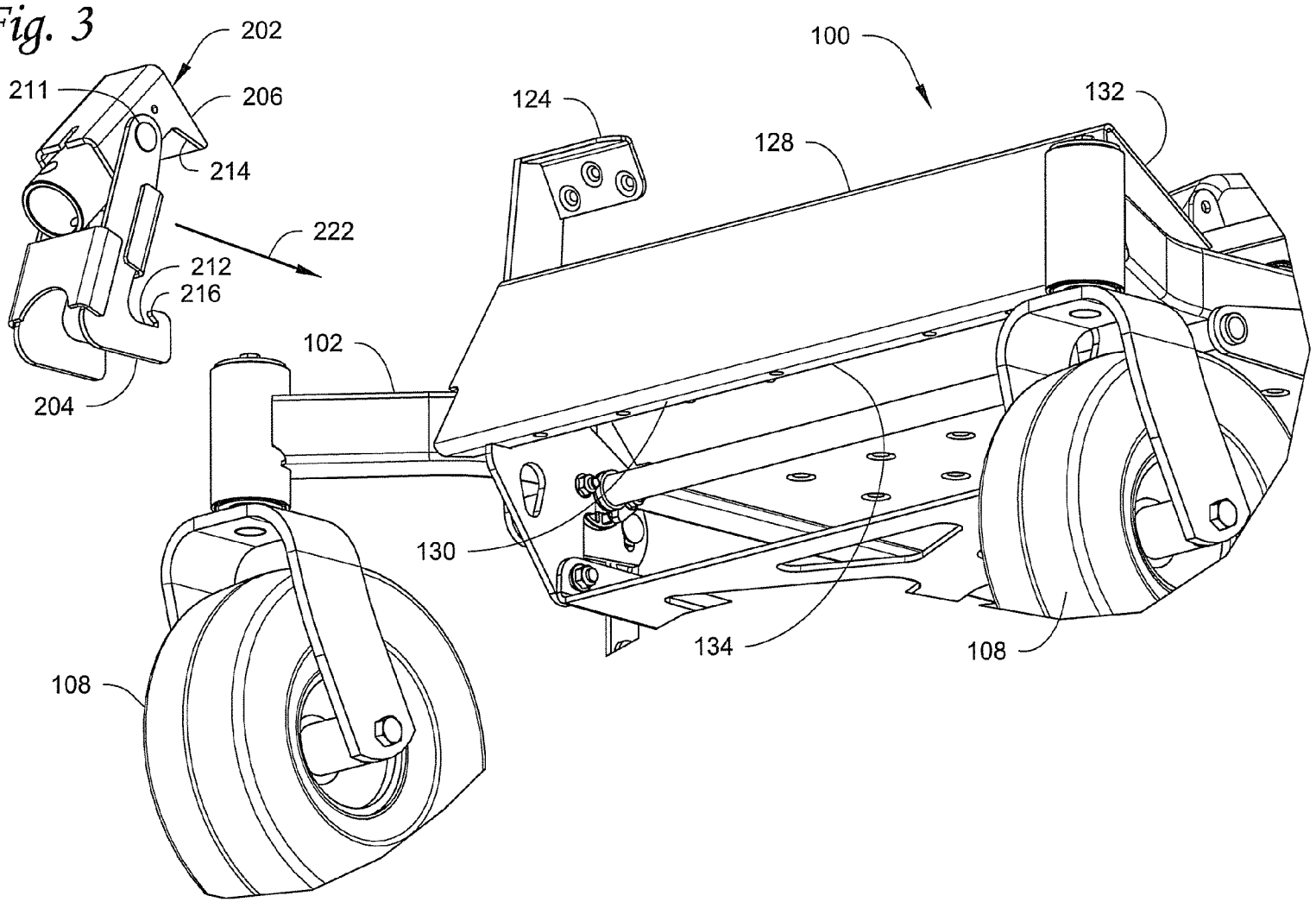
FIG. 3 is an enlarged perspective view of a portion of the mower of FIG. 1 illustrating attachment of the jack mount.
Figure 4:
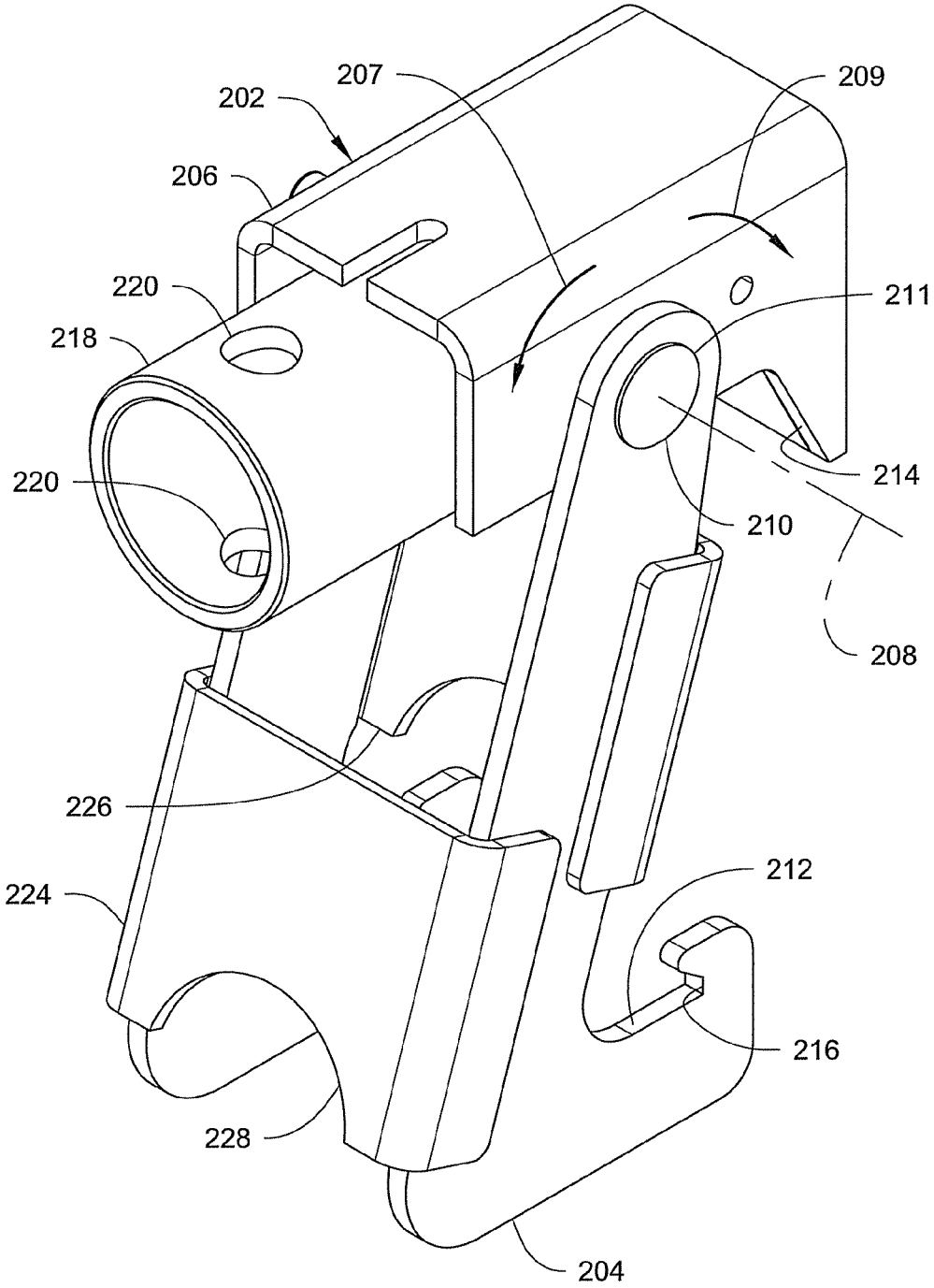
FIG. 4 is an enlarged perspective view of the jack mount of FIG. 1.

With this overview, attention is now directed to an exemplary embodiment of the jack mount 202 as illustrated in FIGS. 3 and 4. The jack mount 202, in one embodiment, is configured to removably attach to a portion of the frame 102 as shown in FIG. 3. In the illustrated embodiment, the jack mount 202 is configured to attach to a footrest 128 that forms a forward transverse portion of the frame as shown in FIGS. 1 and 2. The footrest 128 may also define a first (e.g., lower) portion 130 of the frame, the purpose of which is described in more detail below. A second (e.g., upper) portion 132 of the frame (see also FIG. 6) may be defined by a toeboard of the footrest. The second portion 132 may be tilted to provide a comfortable rest position for the operator's feet during mower operation.

The jack mount 202 may include a first jaw 204 and a second jaw 206 pivotally connected to the first jaw via a pivot joint 211 such that the first and second jaws pivotally oppose (e.g., in a scissor-like fashion) one another. As a result, the second jaw 206 may pivot relative to the first jaw about a pivot axis 208 (as represented by the arrows 207 and 209 in FIG. 4) defined by a pivot pin 210 (e.g., bolt and nut arrangement). In the illustrative example, the first jaw 204 may form a clevis to pivotally receive the second jaw 206 as clearly shown in FIGS. 3 and 4. However, this configuration is not limiting.

The first jaw 204 may further include a first contact surface 212 configured to engage the first portion 130 of the frame 102, while the second jaw 206 may include a second contact surface 214 configured to engage the second portion 132 of the frame. As illustrated in the figures, the second jaw (e.g., the second contact surface) may pivotally oppose the first jaw (e.g., the first contact surface). The first jaw may also include a catch or hook member 216 (e.g., positioned proximate the first contact surface) that engages an edge or lip 134 of the first portion 130 of the frame when the jack mount is attached. As further described below, the hook member 216, in the illustrated embodiment, is beneficial in maintaining the first contact surface 212 in desired contact with the first portion 130 of the frame during use (e.g., it may reduce relative movement between). While not limited to any particular configuration, the jack mount 202 may, when attached to the frame 102, position the second contact surface 214 within a plane that forms an acute angle with a plane containing the first contact surface 212 (see FIG. 7).

In the illustrated embodiment of the jack mount 202, the second jaw 206 may include a first end and a second end. The first end defines the second contact surface 214 as described above, while the second end (positioned opposite the first end) defines a jack receiving member 218. The jack receiving member may be integral with, or otherwise positioned on, the second jaw. As illustrated in FIG. 4, the pivot joint 211 may be located between the first end and the second end (e.g., between the second contact surface 214 and the jack receiving member 218).

The jack receiving member 218 may form a cylindrical tubular member defining apertures 220 configured to align with corresponding apertures 251 (See FIG. 5) formed in a jack point 254 of the jacking device 250 as further describe below.

The jacking apparatus 200 may also include the extensible jacking device 250, an exemplary embodiment of which is illustrated in FIGS. 1, 2, 5, and 7. The jacking device includes a body 252 that may be longitudinally extended and retracted to effectively raise and lower, respectively, the mower when the jacking member and jack mount are attached to the frame 102. The jacking device may further include the jack point 254 (see FIG. 5) to selectively attach the jacking device to the jack receiving member 218 of the jack mount 202. In the illustrated embodiment, the jack point 254 may take the shape of a cylindrical tubular member configured to receive the male jack receiving member 218 therein. When correctly positioned around the jack receiving member 218, a pin 256 (see FIG. 5) may be placed through the aligned apertures 251 of the jack point 254 and apertures 220 of the jack receiving member 218 to secure the jacking device relative to the jack mount. A cotter pin (not shown) or similar locking device may be provided to positively retain the pin 256 in place.

The jacking device 250 may also include a ground contacting portion, e.g., foot 258, positioned at an end (e.g., lower end) of the device. The foot 258 may be configured to engage the ground surface 107 (see FIG. 2) during the jacking operation. In one embodiment, the jacking device achieves longitudinal extension and retraction by the use of a ball screw (not shown). To activate the ball screw, a crank handle 260 may be provided. Rotation of the handle 260 about an axis of the body 252 (or, alternatively, about an axis perpendicular to the body when a side-winding jacking device (not shown) is used) may cause a lower longitudinal section of the jacking device to displace relative to an upper longitudinal section, thereby lengthening the device 250.

While not wishing to be bound to any particular configuration, the jacking device 250 may, in one embodiment, be a Bulldog topwind round jack model 150443 distributed by Cequent Performance Products of Mosinee, Wis., USA. The tubular jackpoint 254 may have an inner diameter of about 2 to about 2.12 inches, e.g., about 2.06 inches. However, different jack configurations, as well as those having components of different sizes, are also contemplated within the scope of the invention. Similarly, while the jackpoint 254 is welded to the body of the jacking device in the illustrated embodiment, other attachment methods (e.g., bolt-on) are also possible.

Operation of the illustrative jacking apparatus 200 will now be described with reference primarily to FIGS. 3-7. When access to the underside of the deck 114 is desired, the engine 104 may be deactivated and the mower parking brake engaged. Once the operator steps off the mower, the jack mount 202 may be positioned as shown in FIG. 3, e.g., with the second contact surface 214 of the second jaw 206 pivoted away from the first contact surface 212 of the first jaw 204. With the jaws spread apart as shown in FIG. 3, the jack mount may be moved towards the frame 102 as indicated by the arrow 222 in FIG. 3.

Figure 6:
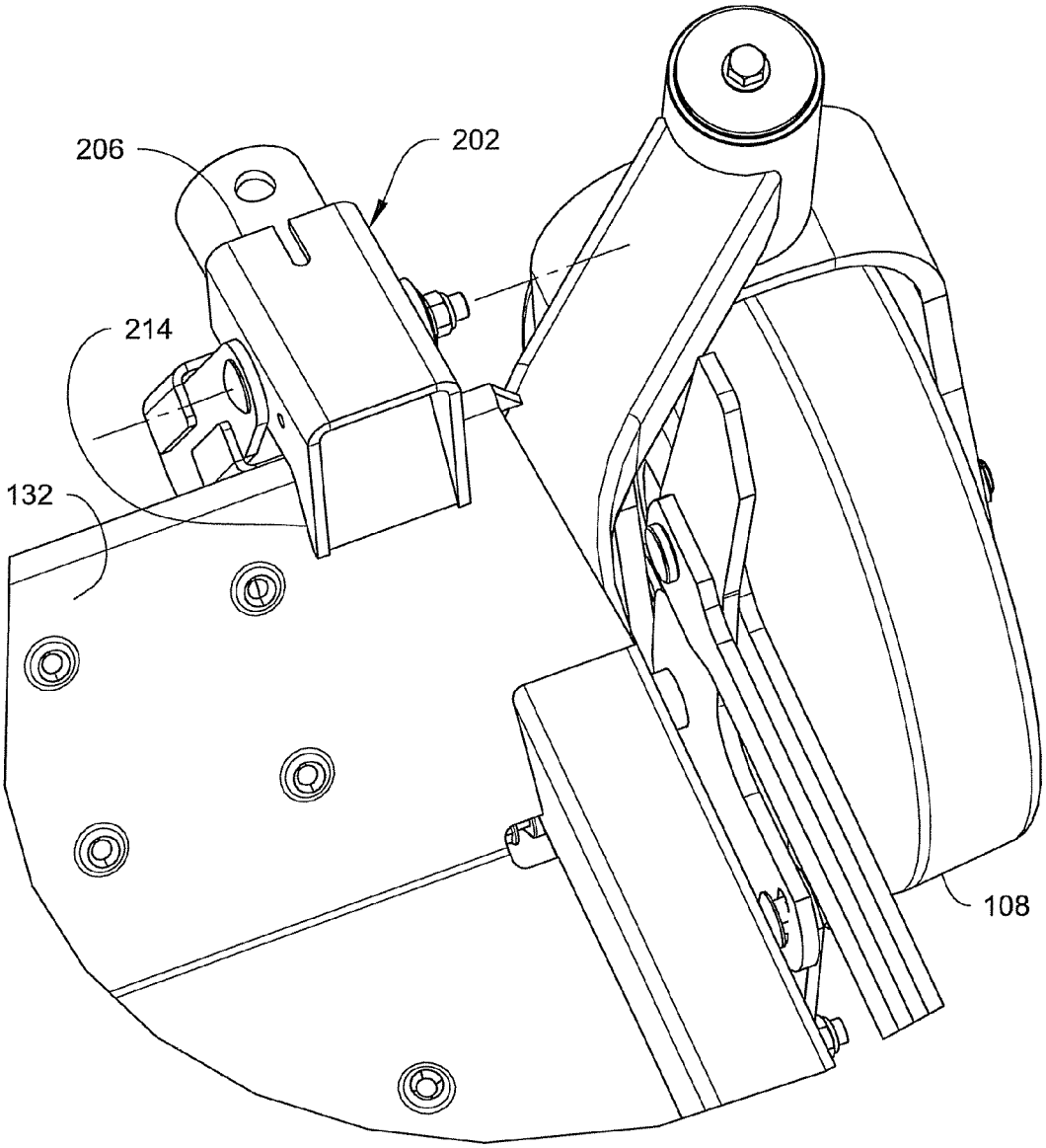
FIG. 6 is an enlarged perspective view of a portion of the mower illustrating an upper portion of the exemplary jack mount of FIG. 4 as attached to the mower.
Figure 7:
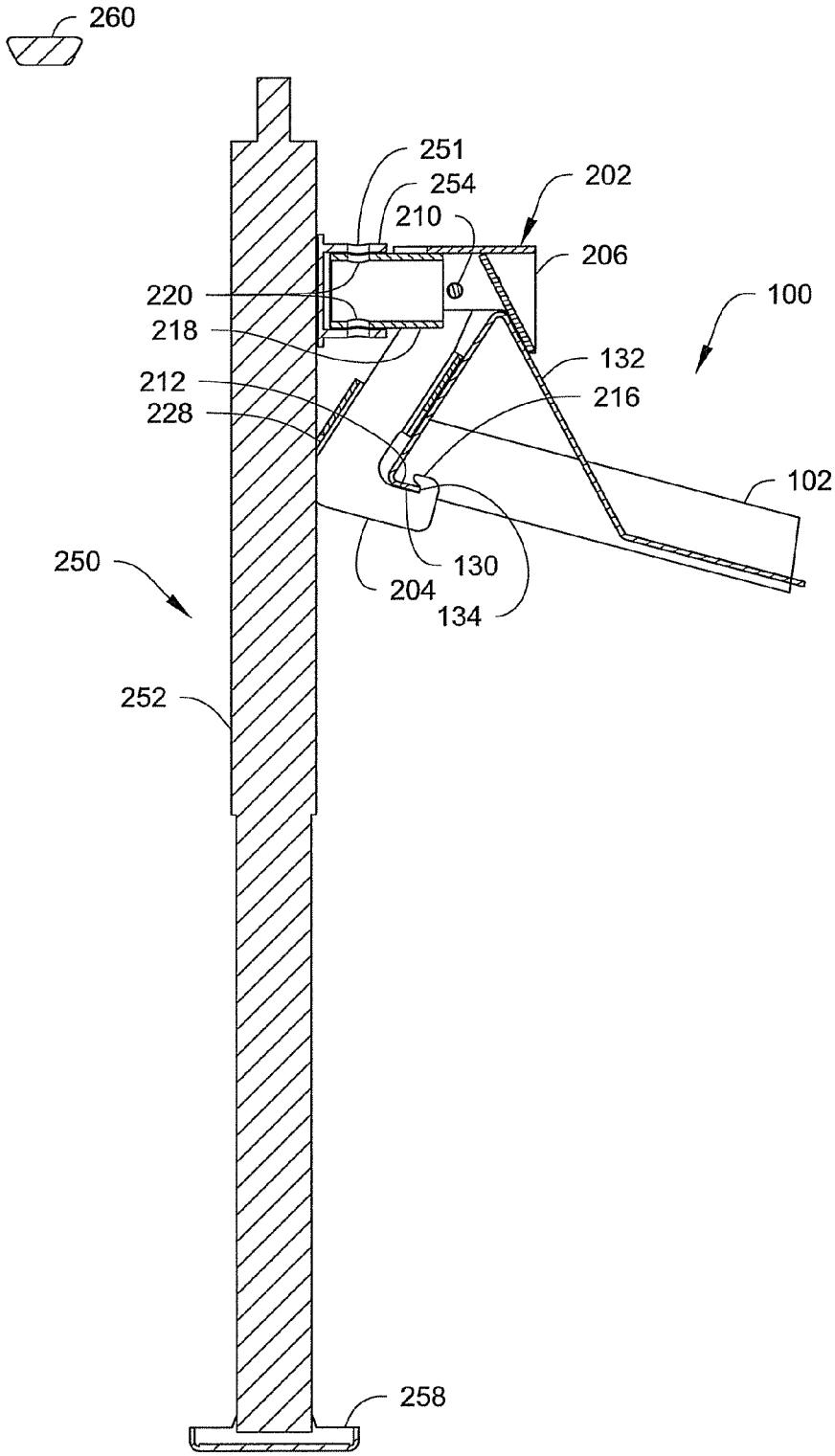
FIG. 7 is a section view taken along a vertical plane passing through the jacking apparatus when the jacking apparatus is in a jacked position and the mower is in the corresponding maintenance configuration as shown in FIG. 2.

When in close proximity to the frame, the first contact surface 212 of the first jaw 204 may be positioned in contact with the first lower portion 130 of the frame 102. When correctly positioned, the hook member 216 may be slid over the edge 134 until it engages the frame as shown in FIG. 7. With the first jaw 204 so positioned, the second jaw 206 may be pivoted about the pivot axis 208 (see FIG. 4) in the direction 209 until the second contact surface 214 rests against the second upper portion 132 of the frame 102 as shown in FIG. 6. The weight distribution of the second jaw 206 (and/or the frictional resistance of the pivot joint 211) may be such that the second jaw is slightly biased towards this closed position, e.g., biased in the direction indicated by arrow 209 in FIG. 4 (in other embodiments, a spring or other mechanism may be used to provide the biasing force). As a result, the jack mount 202 may generally maintain its position on the frame once set in place as shown in FIG. 6.

While the jack mount 202 is shown in a particular transverse location along the footrest 128 of the frame, it may be positionable at a plurality of locations along the footrest, or at other locations on the frame, without departing from the scope of the invention.

Figure 5:
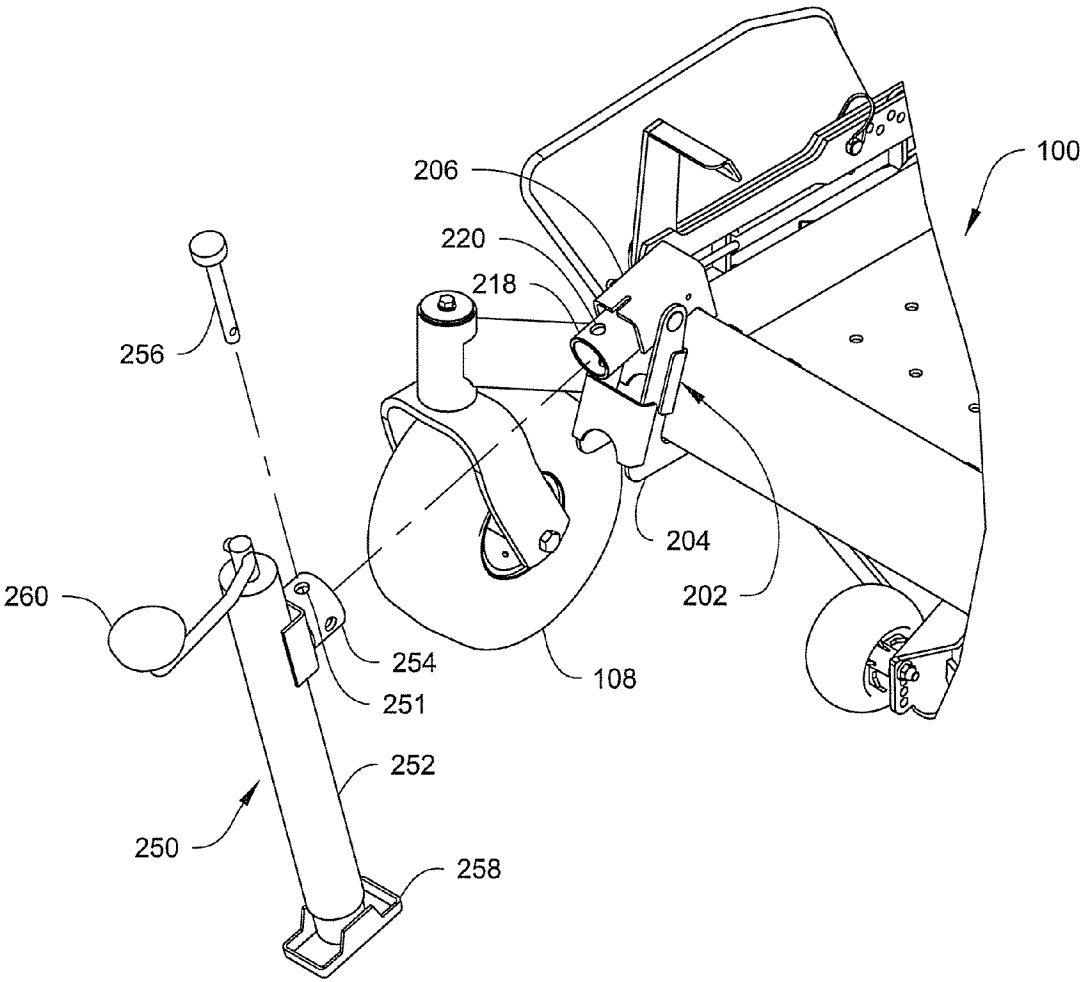
FIG. 5 is an enlarged perspective view of the mower with the jack mount attached, but prior to attachment of the jacking device.

With the jack mount 202 in place, the operator may position the jacking device 250 (configured in a retracted configuration as shown in FIG. 5) such that the jack receiving member 218 enters the tubular jack point 254. When coupled in this manner and the apertures 251 aligned with the apertures 220, the pin 256 may be attached as also indicated in FIG. 5.

By then placing the foot 258 of the jacking device on the ground, and extending the body 252 (e.g., by rotating the crank handle 260), the jacking device may apply a vertical jacking or lifting force to the jack mount 202 via the interconnection with the jack receiving member 218. The force applied by the jacking device to the jack receiving member may produce a moment of the second jaw about the pivot axis 208 (e.g., in the direction 209 of FIG. 4), wherein the moment is reacted by contact between the second contact portion 214 (of the second jaw) and the second portion 132 of the frame. That is, application of the lifting force to the jack receiving member 218 by the jacking device 250 forces the second contact surface 214 towards the first contact surface 212 and against the second upper portion 132 of the frame. As a result, the jack mount 202 (e.g., first and second jaws) is operatively clamped to the frame, via the first and second contact surfaces, by application of the vertical jacking force applied to the jack receiving member 218.

FIG. 7 illustrates a section view of the apparatus 200 when attached to the mower 100 and the latter is in the elevated maintenance configuration of FIG. 2. As illustrated in this view, the jacking force is applied to the vehicle via contact between the first jaw, e.g., the first contact surface 212, and the first portion 130 of the frame. In the illustrated embodiment, the jack mount 202 may include one or more plates 224, 226 as shown in FIG. 4. The plates, e.g., plate 224, may define or otherwise form a recess or cutout 228 that has a curvature configured to generally match that of the body 252 of the jacking device 250. The cutout may provide clearance for the body of the jacking device 250 when the latter is initially attached to the jack mount 202 but before the device is extended. Moreover, when the mower is elevated as shown in FIG. 7 (e.g., the jacking device is extended), the body 252 of the jacking device may be received within the cutout 228 and nest therein in an abutting manner. Such a configuration may provide side-to-side support to the jacking device 250.

Once the mower 100 is positioned at the designated height, jack stands (not shown) can be positioned at appropriate locations to support the vehicle. The jacking device 250 can then be retracted until the weight of the mower is supported by the jack stands. At this point, the jacking device 250 may be removed from the jack receiving member 218. At maintenance completion, the process may be repeated to: elevate the mower 100; remove the jack stands; and lower the mower.

In the illustrated embodiment, the jacking device 250 and the jack mount 202 may be stored remotely from the mower. In alternate embodiments, either one or both of these components may be stored at a location on the mower.

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A jacking apparatus for elevating a portion of a vehicle relative to a ground surface, the apparatus comprising:
- a jack mount removably attachable to a frame of the vehicle, the jack mount comprising:
  - a first jaw comprising a first contact surface configured to engage a first portion of the frame;
  - a second jaw comprising a second contact surface configured to engage a second portion of the frame, the second jaw pivotally connected to the first jaw via a pivot joint such that the second contact surface pivotally opposes the first contact surface; and
  - a jack receiving member located on the second jaw; and
- an extensible jacking device, the jacking device including:
  - a jack point configured to attach to the jack receiving member of the jack mount; and a ground contacting portion;
- wherein the jack mount is clamped to the frame, via the first and second contact surfaces, by application of a vertical jacking force applied to the jack receiving member, and wherein the jack receiving member comprises a cylindrical tubular member defining apertures configured to align with corresponding apertures formed in the jack point.

2. The apparatus of claim 1, wherein the jack mount is attachable to the frame at a plurality of locations along the frame.

3. The apparatus of claim 1, wherein the jack receiving member is located on the second jaw on a side of the pivot joint opposite the second contact surface.

4. The apparatus of claim 1, wherein the vertical jacking force applied by the jacking device to the jack receiving member results in a moment of the second jaw about the pivot joint, the moment reacted by contact between the second contact surface and the second portion of the frame.

5. The apparatus of claim 4, wherein the jacking force is applied to the vehicle via contact between the first contact surface and the first portion of the frame.

6. The apparatus of claim 1, further comprising a pin receivable within the apertures of the cylindrical tubular member and the apertures formed in the jack point when the jacking device is attached to the jack mount.

7. The apparatus of claim 1, wherein the first jaw comprises a hook member configured to engage an edge of the first portion of the frame when the jack mount is attached, the hook member operable to maintain the first contact surface in contact with the first portion of the frame.

8. The apparatus of claim 1, wherein the first jaw forms a clevis to pivotally receive the second jaw.

9. A jacking apparatus for elevating one end of a vehicle relative to a ground surface, the apparatus comprising:
- a jack mount removably attachable to a frame of the vehicle, the jack mount comprising:
  - a first jaw comprising a first contact surface that is configured to engage a lower portion of the frame; and
  - a second jaw pivotally attached to the first jaw via a pivot joint, the second jaw comprising: a first end defining a second contact surface configured to engage an upper portion of the frame; and a second end defining a jack receiving member, wherein the pivot joint is located between the second contact surface and the jack receiving member; and an extensible jacking device, the jacking device comprising: a jack point configured to attach to the jack receiving member of the jack mount; and a ground contacting portion, wherein application of a vertical jacking force to the jack receiving member produces a moment of the second jaw about the pivot joint.

10. The apparatus of claim 9, wherein application of the vertical jacking force to the jack receiving member by the jacking device forces the second contact surface against the upper portion of the frame.

11. The apparatus of claim 9, wherein the first jaw further comprises a hook member proximate the first contact surface, the hook member configured to engage a lip of the frame to maintain position of the first jaw relative to the frame.

12. The apparatus of claim 9, wherein the jack receiving member comprises a cylindrical tubular member.

13. The apparatus of claim 9, further comprising a pin configured to pass through aligned apertures formed in the jack point and the jack receiving member when the jacking device is attached to the jack mount.

14. The apparatus of claim 9, wherein the first jaw forms a clevis to receive the second jaw.

15. A lawn mower comprising:

a frame comprising a footrest; and a jacking apparatus for elevating a forward end of the mower relative to a ground surface, the apparatus comprising:

a jack mount removably attachable to the footrest of the mower, the jack mount comprising:

a first jaw comprising a first contact surface to engage a lower portion of the footrest; and a second jaw comprising a second contact surface for engaging a toe board of the footrest, the second jaw pivotally connected to the first jaw, wherein the second jaw further comprises a jack receiving member; and an extensible jacking device, the jacking device comprising: a jack point configured to removably attach to the jack receiving member of the jack mount; and a ground contacting portion;

wherein application of a vertical jacking force by the jacking device to the jack mount causes the first and second jaws to clamp to the footrest.

16. The mower of claim 15, wherein the jack mount defines a recess configured to receive and abut the jacking device when the jacking device is extended.

17. A jacking apparatus for elevating one end of a vehicle relative to a ground surface, the apparatus comprising:

a jack mount removably attachable to a frame of the vehicle, the jack mount comprising:

a first jaw comprising a first contact surface that is configured to engage a lower portion of the frame; and a second jaw pivotally attached to the first jaw via a pivot joint, the second jaw comprising: a first end defining a second contact surface configured to engage an upper portion of the frame; and a second end defining a jack receiving member, wherein the pivot joint is located between the second contact surface and the jack receiving member; and an extensible jacking device, the jacking device comprising: a jack point configured to attach to the jack receiving member of the jack mount; and a ground contacting portion;

wherein a lifting force applied by the jacking device to the jack receiving member corresponds to a clamping force applied by the second contact surface against the upper portion of the frame.

* * * * *